United States Patent [19]

LaRue et al.

[11] Patent Number: 4,627,366

[45] Date of Patent: Dec. 9, 1986

[54] PRIMARY AIR EXCHANGE FOR A PULVERIZED COAL BURNER

[75] Inventors: Albert D. LaRue, Uniontown; Roger A. Clocker, Wadsworth; Norman F. Smith, Jr., Doylestown, all of Ohio

[73] Assignee: The Babcock & Wilcox Company, New Orleans, La.

[21] Appl. No.: 776,194

[22] Filed: Sep. 16, 1985

[51] Int. Cl.[4] ..... F23D 1/00

[52] U.S. Cl. ..... 110/263; 110/264; 110/347

[58] Field of Search ..... 110/263, 264, 265, 347

[56] References Cited

U.S. PATENT DOCUMENTS 4,471,703 9/1984 Vatsky et al. ..... 110/263

4,497,263 2/1985 Vatsky et al. ..... 110/347

*Primary Examiner*—Edward G. Favors

*Attorney, Agent, or Firm*—Robert J. Edwards; Michael L. Hoelter

[57] ABSTRACT

A primary air exchange device for a burner of a pulverized fuel, such as coal, with burner including a supply line through which a primary air and pulverized fuel mixture is supplied. A separator having its inlet within the supply line is dimensioned to receive and remove approximately one half of the primary air while the remaining half of the primary air moves past the separator. Additionally approximately 90% of the pulverized fuel passes the separator while only about 10% of the pulverized fuel enters the separator along with approximately one half the primary air. This air and small quantity of fuel mixture is delivered from the separator to a nozzle where it is discharged into a burner throat of a furnace. Hot air is injected into the remaining mixture of half the primary air plus the large percentage of pulverized fuel to heat this fuel before it is injected into the furnace for ignition.

11 Claims, 4 Drawing Figures

PRIMARY AIR EXCHANGE FOR A PULVERIZED COAL BURNER

FIELD OF THE INVENTION

The present invention relates in general to pulverized coal burners and in particular to a new and useful primary air exchange for such burners which produces a richer fuel mixture and one which is at a higher initial temperature for improving pulverized coal ignition.

BACKGROUND OF THE INVENTION

Primary air is utilized with pulverized coal burners for preheating the pulverized coal and thereby improving ignition performance of the coal. This is especially important in hard-to-ignite coal. U.S. Pat. No. 4,448,135 to Dougan et al. and assigned to the Babcock and Wilcox Company, discloses an in-line coal air separator which improves low load operation by separating the air entrained with pulverized coal into a rich-coal stream and into a lean-coal moisture-laden stream.

U.S. Pat. Nos. 4,173,189 to Cooper and 4,381,718 to Carver et al. both disclose a boiler system wherein the combustion air is preheated. U.S. Pat. No. 4,412,496 to Trozzi relates to a boiler system wherein the air-coal stream is split into separate streams. U.S. Pat. No. 4,492,171 to Brashears et al. discloses a solid fuel burner wherein the fuel is mixed with combustion air prior to being burned. U.S. Pat. No. 4,515,094 to Azuhata et al. discloses a burner having primary and secondary nozzles for jetting into the combustion chamber a fuel stream having a particular ratio. These references are all drawn to efforts in improving the operation and efficiency of solid fuel burners.

While it is known that the delivery of hotter primary air to the burner will significantly improve the ignition performance of different fuels and especially that of low volatile matter coals which are notoriously difficult to ignite, generally temperatures of only up to 200° F. are possible. Primary air leaving a pulverizer usually has a temperature of appproximately 150° to 175° F. as coal volatile matter drops, and this temperature can be as high as 200° F. for low volatile coal. Further increases would be beneficial but are limited by the temperature of the primary air available to the pulverizer mill, and by the mechanical design of the mill which generally has a maximum allowable mill outlet temperature of 200° F.

An alternate approach would be to use a bin system which uses a "fresh" primary air stream to transport coal from the bin to the burners. Primary air streams for transporting such coal may for example range from 500° to 600° F. This would greatly improve the ignition performance of very low volatile coal. Several problems exist however, when using a bin system. Such systems generally pneumatically transport the coal from a pulverizing mill to a bin after which this air is vented. The air that is then used to transport the coal from the bin to the burners is heated and often is hotter than that achievable when the same air is used to convey the pulverized coal directly from the mill to the burners. This is because the limitations of the mill are by-passed. However, bin systems are essentially never used in modern plants due to the added expense and the potential explosion hazards associated with stored pulverized coal. These expenses are significant due to the use of air/coal separation equipment, storage bins, controls, inerting equipment and the like. Bin systems also have the disadvantage of difficulties in metering the coal flow. For this reason a primary air exchange system is preferable over a bin system.

It is also advantageous to improve ignition characteristics over those available in conventional systems. Burners with poor ignition performance on difficult fuels burn large quantities of oil or natural gas to maintain fuel stability. This is a poor use of a precious resource and expensive as these auxiliary fuels are two or three times more costly than coal on a BTU basis. Therefore, incremental cost increase for improved burner performance is easily justified.

Another means for firing different fuels in conventional burners is by resorting to a special furnace design. Low volatile coals and anthacites are usually fired in a downshot "W" furnace, with the lower furnace refractory lined. This arrangement relies on a hot furnace and additional residence time to ignite and burn out these coals. Such a furnace design is effective but considerably more expensive than conventional wall-fired designs. A primary air exchange burner permits the use of conventional furnace designs for a much broader range of difficult-to-ignite fuels.

Accordingly, an object of the present invention is to improve pulverized coal ignition while avoiding a reduction in efficiency of the burner. Another object of the invention is to provide a primary air exchange for a pulverized coal burner which is simple in design, rugged in construction and economical to manufacture. A further object of this invention is to remove a portion of the primary air from the coal/air mixture prior to combustion and substitute this removed air with heated air whose quantity is determined by the ignition requirements of the to-be-burned coal.

SUMMARY OF THE INVENTION

The present invention is drawn to a primary air exchange device and a method which improves pulverized coal ignition. According to the invention, an in-line separator effectively removes from the burner typically 50% of the primary air used to transport the pulverized coal supplied to a burner. At the same time only a small portion of the pulverized coal, i.e. approximately 10% is removed. Thus a richer fuel mixture remains in the burner nozzle downstream of the in-line separator. This richer fuel mixture improves the ignition of pulverized coal and especially during turndown conditions where a more dilute fuel mixture normally occurs which hampers ignition.

By removing approximately one half of the primary air along with a small fraction of the coal, the remaining coal can be supplied to the nozzle along with additional air heated typically to 600° F. According to the invention, hot air is provided from the secondary air heaters and routed through a booster fan to raise its static pressure by approximately 5 inches $H_2O$ before being routed to individual burners. The quantity of this hot air is regulated separately for each pulverizer group by conventional air flow measurement equipment, e.g. venturi and air control dampers. This hot air enters the burner nozzle just downstream of the in-line separator and mixes with the remaining coal-rich half of the pulverized coal and primary air mixture. The temperature of this mixture can thus be made to exceed 300° F. which significantly increases the ignitability of the pulverized coal.

A principal advantage of the present invention is its ability to provide a hot primary air/pulverized coal mixture to the burner to facilitate ignition. In most cases this mixture is much hotter than that obtainable in conventional direct fired pulverizer systems. Furthermore, advantages become more apparent when the alternatives of a bin system or a special furnace design are considered.

The present invention is particularly useful in igniting difficult-to-ignite coal, such as low volatile matter coal. It is also particularly advantageous when used in combination with an enhanced ignition register design although it is capable of use independant of such a design.

DESCRIPTION OF THE PREFERRED EMBODIMENTS

Figure 1:
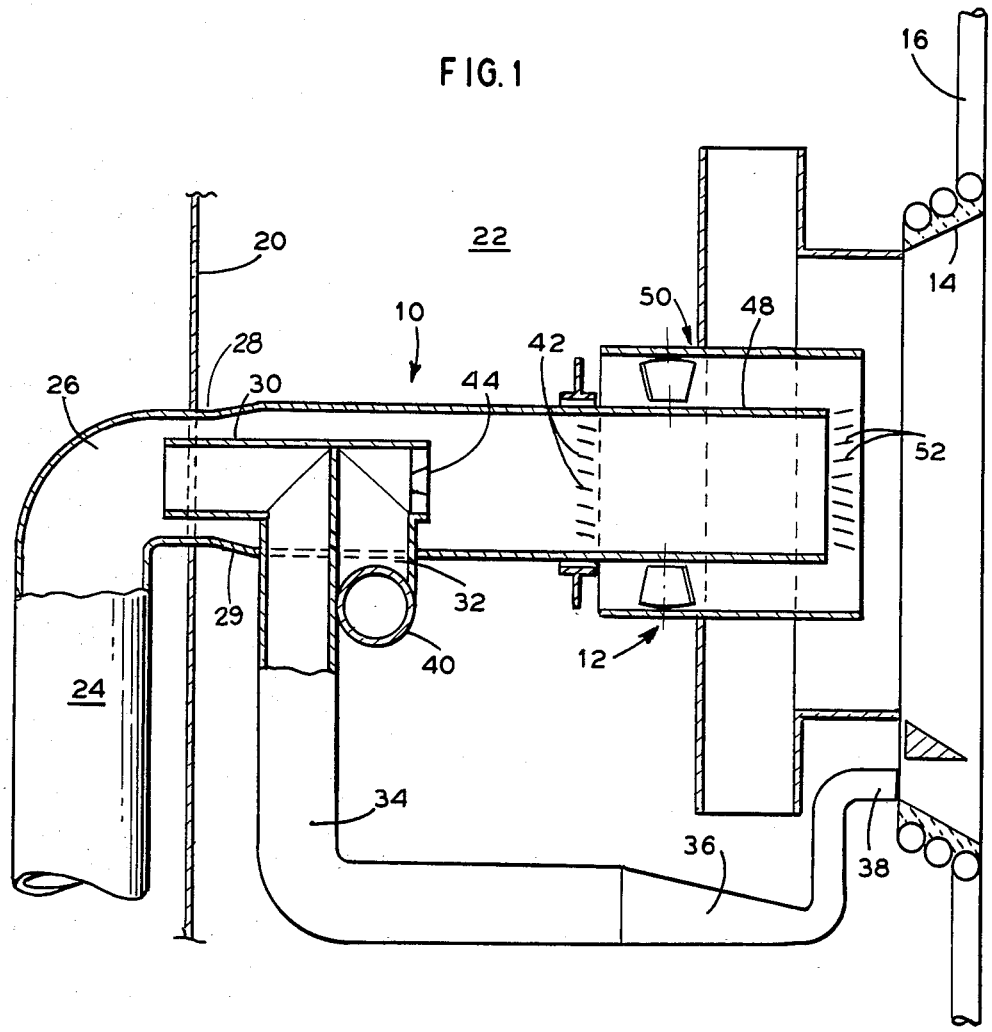
FIG. 1 is a pictorial side sectional view partially broken away of the primary air exchange pulverized coal burner of the present invention.

Referring to the drawings, the invention embodied in FIG. 1 comprises primary air exchange device 10 which is connected to pulverized coal burner 12 for supplying pulverized coal to burner throat 14. Throat 14 is lined with refractory material and is secured to wall 16 of a furnace. Spaced from wall 16 is wind box wall 20 and wind box 22 is located between walls 16 and 20.

Primary air and pulverized coal is supplied through supply line 24 to primary air exchange device 10 which includes elbow 26 connecting supply line 24 to rich fuel line 28. Centered in rich fuel line 28 is in-line separator 30 having an opening selected so that approximately 50% of the primary air enters separator 30 and the other 50% bypasses it and flows through rich fuel line 28.

Because the pulverized coal plus primary air from supply line 24 turns approximately 90° through elbow 26, the centrifugal force causes most of the pulverized coal to shift to the outside curved region of elbow 26. Due to this shift only about 10% of the pulverized coal along with approximately 50% of the primary air flows into separator 30. This mixture is conveyed via conduit 34 and transition piece 36 to lean mixture nozzle 38. Lean mixture nozzle 38 discharges its contents through burner throat 14 into the furnace where the small quantity of coal therein is ignited by the main flame in the burner throat and in the furnace. For the purpose of igniting the rich fuel mixture coming from burner nozzle 12, an ignition lance (not shown) is utilized.

The other 90% of the coal plus the remaining half of the primary air passes through rich fuel line 28 and is supplied to burner 12. Conical transition piece 29 connects the small diameter portion of fuel rich line 28 to large diameter nozzel 48. This change in diameter is to keep the velocity of the fuel rich mixture uniform as it travels past primary air exchange device 10. In addition, the exit velocity of this fuel rich mixture as it exits nozzel 48 is equal to or lower than the velocity in the smaller diameter portion of fuel line 28 and in injector 32.

Injector 32 discharges hot air supplied from hot air line 40 into the rich fuel mixture through vanes 44. Another set of vanes, vanes 42, are provided in large diameter nozzle 48 to facilitate the mixing of this heated air with the coal and similarly vanes 44 in injector 32 are utilized to disperse the hot air into the fuel mixture.

Nozzle 48 may also be equipped with impeller 52 for coal dispersal at the nozzle exit. Low $NO_x$ applications preferentially do not use this impeller while other applications may make use of it. Burner 12 includes register assembly 50 of conventional design.

Figure 2:
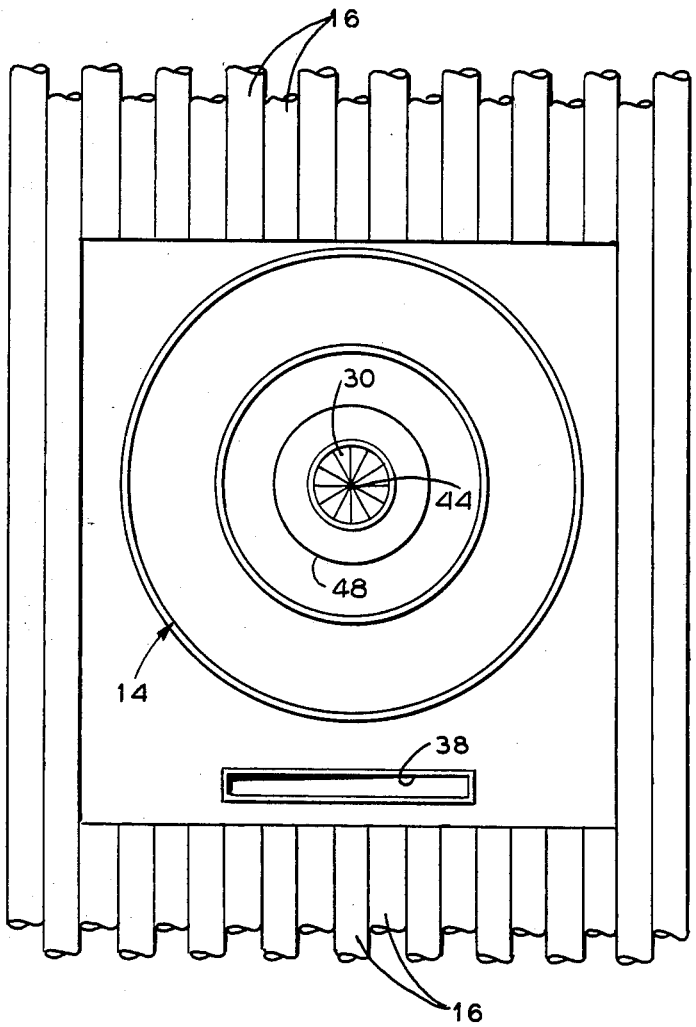
FIG. 2 is an elevational view partially broken away taken in a direction facing the burner throat shown in FIG. 1 with some components removed for clarity.

FIG. 2 illustrates burner throat 14 in a direction facing the nozzle with vanes 42, register assembly 50 and impeller 52 removed for clarity. As noted above, burner throat 14 is generally refractory lined in order to increase the temperature in the ignition zone and to facilitate accommodating lean mixture nozzle 38.

Figure 3:
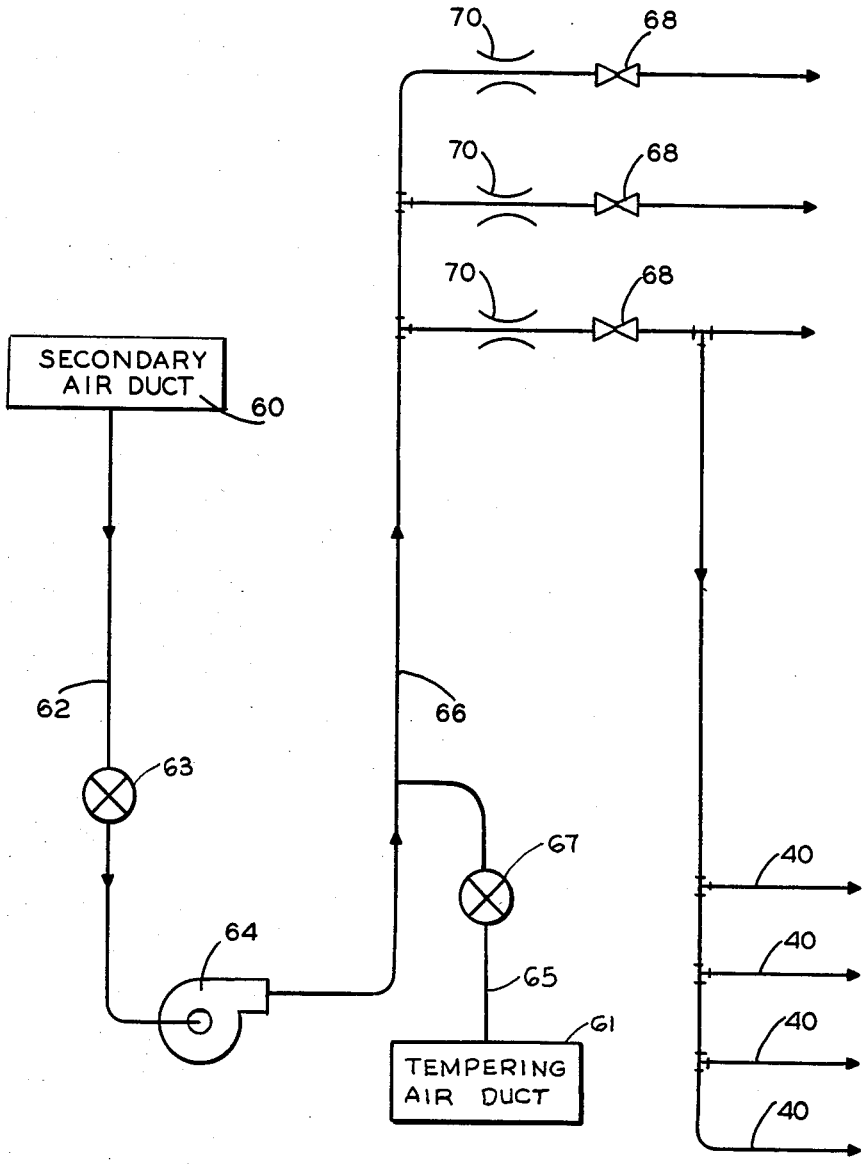
FIG. 3 is a schematic diagram showing the manner of generating and controlling the hot secondary air.

FIG. 3 is a schematic of the equipment utilized to supply hot air line 40 with hot air. This heated air is preferably at a temperature of about 500° to 600° F. which results in a combined temperature for the air/fuel mixture exceeding 300° F. in nozzle 48. Hot secondary air travels from secondary air duct 60 through duct 62 and control damper 63 and its static pressure is increased by booster fan 64 which supplies air to duct 66. Unheated air from tempering air duct 61 is supplied thru duct 65 and control damper 67 to duct 66. Control dampers 63 and 67 regulate the temperature of air in duct 66 to temperatures less than 500° to 600° F. when easier to ignite coals are used. Duct 66 then splits into several branches each equipped with control dampers 68 and with venturi 70 or some other air measuring device. Each Venturi 70 is utilized in combination with a control damper 68 to control the flow of air to a plurality of burners. For example, as shown lower control damper 68 is connected to four branch lines 40, each supplying a separate burner nozzle.

Figure 4:
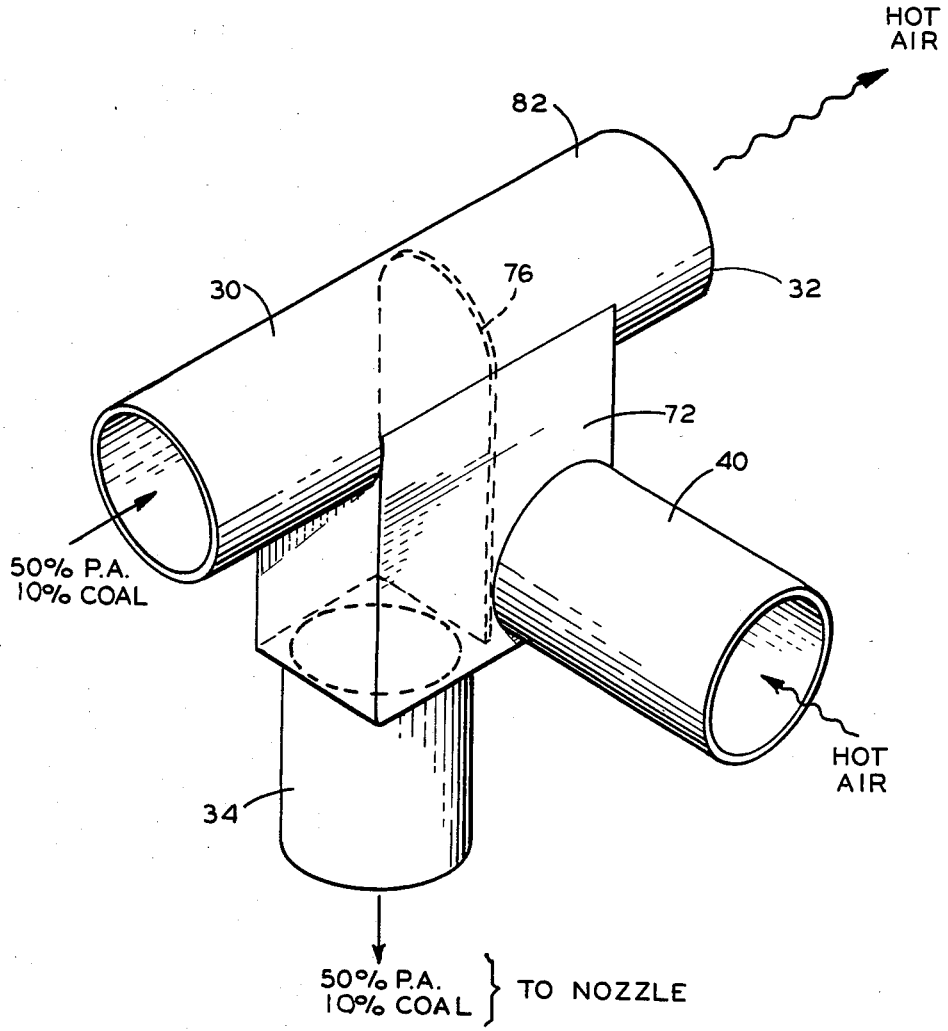
FIG. 4 is a perspective view partially broken away of the in-line separator for removing approximately one half of the primary air and only about 10% of the pulverized coal.

FIG. 4 illustrates the internal separator assembly for primary air exchange device 10. Separator 30 and injector 32 are formed as a unit and this unit includes mount 72 which supports tube 82 that forms the inlet end of separator 30 and the outlet end of injector 32. Partition 76 extends within tube 82 and also mount 72 and partition 76 separates separator 30 from injector 32. As shown, hot air line 40 is connected to the side of mount 72 while conduit 34 extends downwardly from mount 72, on an opposite side of parition 76.

In accordance with the invention, the quantity of hot air injected into the furnance can be varied in accordance with the pulverizer load and as necessary to maintain flame stability. The hot air for each burner proceeds from control dampers 68 to the individual burners by way of lines 40. The example shown in FIG. 3 shows a situation where four burners are provided per pulverizer.

Primary air exchange device 10 is generally situated with the connecting pipes coupled through the bottom of the nozzle. This is done to avoid erosion from the majority of the coal which will be traveling along the top inside wall of elbow 26 and fuel line 28 and nozzle 48. In different cases where the burner elbow enters from an angle, primary air exchange device 10 may be re-oriented.

For instances where coal volatile matter fluctuates significantly or other factors vary the ignition characteristics, it is prudent to temper the air being supplied through air injector 32. That is, ambient tempering air is mixed with the secondary air to reduce the temperature of the air provided. This is preferred to simply shutting off the hot air since without this additional air the coal transport velocity would drop greatly and would result in coal burning back within burner 12. Alternatively, a separate hot air source at even greater temperatures than the secondary air could be used with extremely difficult to burn coals.

The use of recirculated flue gas in place of hot air for injection into burner 12 is also possible in order to lower $NO_x$. The use of flue gas significantly lowers the stoichiomerty at the exit of burner 12. This is critical since $NO_x$ abatement with coal is directly linked to reducing the availability of oxygen during the devolitization stage during which nitrogenous species are released from the coal particles.

The location of lean mixture nozzle 38 is selected for convenience in new boiler applications. Here the bent tube openings for the throat are simply extended a few inches to accommodate the nozzle, i.e. make the circular opening slighty oblong. Another port location may be simpler for retrofit applications, i.e. adjacent to the throat.

While specific embodiments of the invention have been shown and described in detail to illustrate the application of the principles of the invention, it will be understood that the invention may be embodied otherwise without departing from such principles.

What is claimed is:

1. A primary air exchange device for a pulverized fuel burner comprising:

a supply line for supplying a combination of primary air and pulverized fuel to a furnace;

separator means secured to said supply line for removing from said supply line a first mixture comprising generally one half of said primary air and a relatively small percentage of said pulverized fuel;

a rich fuel line connected to said supply line for conveying a second mixture comprising the remainder of said primary air and the remaining relatively large percentage of said pulverized fuel past said separator, said rich fuel line forming a burner nozzle for injecting said second mixture into said furnace;

a hot air injector intermediate said furnace and said separator means, for injecting hot air into said rich fuel line for mixing with said second mixture; and, hot air means connected to said hot air injector for supplying said hot air to said hot air injector.

2. A device as set forth in claim 1 further comprising:

a burner throat configured having said rich fuel line positioned to supply said second mixture to said throat;

a conduit connected to said separator means for conveying said first mixture; and a secondary nozzle connected to said conduit and extending to said throat for discharging said first mixture into said throat.

3. A device as set forth in claim 2 wherein said hot air injector includes an outlet end and said separator includes an axially aligned inlet end facing in a direction opposite to said outlet end of said injector.

4. A device as set forth in claim 3 wherein said rich fuel line comprises a first small diameter portion and a second large diameter portion.

5. A device as set forth in claim 4 wherein said separator means includes means for concentrating said pulverized fuel in a region of said supply line.

6. A device as set forth in claim 5 wherein said separator means includes an elbow secured to said supply line and said pulverized fuel flows through said elbow and is concentrated along an outer radius of said elbow.

7. A device as set forth in claim 2 wherein said conduit and an inlet of said injector extend downwardly from said rich fuel line.

8. A device as set forth in claim 1 wherein said hot air means comprise a heated air supply line and a tempering air supply line coupled to said hot air injector, said hot air means further comprising flow control means in each of said supply lines for regulating the temperature and flow of said hot air to said injector.

9. A device as set forth in claim 8 further comprising:

a tube concentrically disposed in said rich fuel line;

a box connected to said tube and in communication with an interior of said tube; and, a partition in said box and in said tube dividing said box and said tube into first and second parts thereof said first part of said box and said first part of said tube forming said separator and said second part of said box and said second part of said tube forming said hot air injector.

10. A method of exchanging primary air used to convey pulverized fuel to a pulverized fuel burner comprising:

supplying a combination of pulverized fuel and primary air through a supply line;

removing from said supply line a first mixture comprising generally one half of said primary air plus a relatively small percentage of said pulverized fuel;

passing a second mixture comprising the remainder of said primary air and the remaining relatively large percentage of said pulverized fuel downstream of said separator to a rich fuel line;

injecting hot gas into said rich fuel supply forming a fuel and hot gas mixture; and injecting said fuel and hot gas mixture into a burner nozzle for ignition.

11. A method as set forth in claim 9 including injecting said fuel and hot gas mixture into a burner throat of a furnace near a central area of said burner throat and supplyng said first mixture into said burner throat.

* * * * *